US010746398B2

(12) United States Patent
Ward

(10) Patent No.: US 10,746,398 B2
(45) Date of Patent: Aug. 18, 2020

(54) GAS FUELED WATER HEATER APPLIANCE HAVING A FLAME ARRESTOR

(71) Applicant: Haier US Appliance Solutions, Inc., Wilmington, DE (US)

(72) Inventor: Shaun Michael Ward, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 272 days.

(21) Appl. No.: 15/679,196

(22) Filed: Aug. 17, 2017

(65) Prior Publication Data

US 2019/0056104 A1 Feb. 21, 2019

(51) Int. Cl.

| | |
|---|---|
| ***F23D 14/82*** | (2006.01) |
| ***F23D 14/70*** | (2006.01) |
| ***F24H 1/18*** | (2006.01) |
| ***F24H 9/18*** | (2006.01) |

(52) U.S. Cl.

CPC ..... *F23D 14/82* (2013.01); *F23D 14/70* (2013.01); *F24H 1/18* (2013.01); *F24H 9/1809* (2013.01); *F23D 2203/102* (2013.01); *F23D 2209/10* (2013.01)

(58) Field of Classification Search

USPC ..... 431/346

See application file for complete search history.

(56) References Cited

U.S. PATENT DOCUMENTS

| | | | | |
|---|---|---|---|---|
| 2,277,294 | A * | 3/1942 | Brooks | A62C 4/00 48/192 |
| 2,684,054 | A * | 7/1954 | Carson | F24H 1/205 122/18.31 |
| 5,355,841 | A | 10/1994 | Moore, Jr. et al. | |
| 5,941,200 | A | 8/1999 | Boros et al. | |
| 6,035,812 | A * | 3/2000 | Harrigill | F23D 14/72 122/504 |
| 6,196,164 | B1 | 3/2001 | Valcic | |
| 6,422,178 | B1 | 7/2002 | Lannes et al. | |
| 2013/0280664 | A1* | 10/2013 | Parks | F23D 14/22 431/285 |
| 2016/0346575 | A1* | 12/2016 | Hong | A62C 4/02 |

* cited by examiner

*Primary Examiner* — Grant Moubry
*Assistant Examiner* — John E Bargero
(74) *Attorney, Agent, or Firm* — Dority & Manning, P.A.

(57) ABSTRACT

A gas fueled water heater appliance having a flame arrestor is provided herein. The gas fueled water heater appliance may include a tank for storage of water for heater, a chamber wall, a gas burner, and the flame arrestor. The gas burner may be positioned adjacent to the tank and within a combustion chamber. The flame arrestor may be positioned beneath the gas burner. The flame arrestor may include a bottom plate and a top plate. The bottom plate may define a non-permeable region and a perforated region. The perforated region may include a plurality of apertures extending through the top plate. The top plate may be positioned above the bottom plate and may define a non-permeable region and a perforated region. The perforated region may include a plurality of apertures extending through the top plate.

14 Claims, 12 Drawing Sheets

GAS FUELED WATER HEATER APPLIANCE HAVING A FLAME ARRESTOR

FIELD OF THE INVENTION

The present subject matter relates generally to gas fueled water heater appliances, and more particularly to gas fueled water heater appliances having features limiting flame propagation.

BACKGROUND OF THE INVENTION

A variety of energy sources are used in creating hot water for commercial and residential use including electric, solar, and various fuels. Natural gas and propane are preferred by some customers due to, for example, the relatively quick heating rate. These fuels are supplied as a gas that is burned in a combustion chamber to provide heat energy to raise the water temperature.

Temperatures in the combustion chamber are relatively high and can, for example, reach 600 degrees Fahrenheit or higher during normal operation. A flame is created by burning a mixture of the gaseous fuel and air. Proper combustion requires that the air and fuel are provided within a particular ratio to ensure, for example, complete combustion and avoid wasted fuel or the production of unwanted by-products such as carbon monoxide.

In certain existing water heater appliances, such as residential gas fueled water heater appliances, one or more flame traps are typically provided below the combustion chamber. Generally, such flame traps prevent flames (e.g., from passing out of the combustion chamber). Moreover, the ignition of flammable vapors present outside of the water heater may be prevented. Common systems may include a single metal sheet with a plurality of small openings (e.g., louvers, perforations, or holes). The openings may further permit air into the combustion chamber to sustain or permit combustion at the burner. In order to prevent flames from passing through the flame trap, the openings may typically be limited to sizes no greater than five hundredths of an inch.

However, challenges exist for these common existing systems. As an example, if a water heater appliance is installed in a dusty area containing above average levels of, for example, dirt, oil, or lint, the holes of the flame trap for the water heater can become clogged. The lack of enough air can cause the temperature of the combustion chamber to become too hot or cause an undesirable increase in Carbon Monoxide levels. As another example, existing flame traps may be difficult to manufacture. The relatively small dimensions and low tolerances of the flame traps may require a cumbersome precision or fine blanking process in order to form the plurality of holes. As yet another example, existing systems may lack sufficient structural support. Exposure to flames and/or the high heat environment of a combustion chamber may cause a flame trap to deform or "oil can," which may thus undermine performance of the flame trap or create unwanted noise during operation.

Accordingly, a gas fueled heater appliance with features for preventing flame propagation would be desirable. In particular, it would be advantageous to provide a gas fueled heater appliance with features to address one or more of the above-identified challenges.

BRIEF DESCRIPTION OF THE INVENTION

Aspects and advantages of the invention will be set forth in part in the following description, or may be obvious from the description, or may be learned through practice of the invention.

In one aspect of the present disclosure, a gas fueled water heater appliance is provided. The gas fueled water heater appliance may include a tank for storage of water for heater, a chamber wall, a gas burner, and a flame arrestor. The chamber wall may define a combustion chamber. The gas burner may be positioned adjacent to the tank and within the combustion chamber to heat the water in the tank. The flame arrestor may be positioned beneath the gas burner along a vertical direction. The flame arrestor may include a bottom plate and a top plate. The bottom plate may include an upper surface and a lower surface. The bottom plate may define a non-permeable region and a perforated region. The perforated region may include a plurality of apertures extending through the top plate from the upper surface to the lower surface. The top plate may be positioned above the bottom plate along the vertical direction. The top plate may include an upper surface and a lower surface. The top plate may define a non-permeable region and a perforated region. The perforated region may include a plurality of apertures extending through the top plate from the upper surface to the lower surface. The perforated region of the bottom plate may be axially offset from the perforated region of the top plate.

In another aspect of the present disclosure, a gas fueled water heater appliance is provided. The gas fueled water heater appliance may include a tank for storage of water for heater, a chamber wall, a gas burner, and a flame arrestor. The chamber wall may define a combustion chamber. The gas burner may be positioned adjacent to the tank and within the combustion chamber to heat the water in the tank. The flame arrestor may be positioned beneath the gas burner along a vertical direction. The flame arrestor may include a bottom plate, a top plate, and a baffle. The bottom plate may include an upper surface and a lower surface. The bottom plate may define a non-permeable region and a perforated region. The perforated region may include a plurality of apertures extending through the top plate from the upper surface to the lower surface. The top plate may be positioned above the bottom plate along the vertical direction. The top plate may include an upper surface and a lower surface. The top plate may define a non-permeable region and a perforated region. The perforated region may include a plurality of apertures extending through the top plate from the upper surface to the lower surface. The baffle may be positioned between the lower surface of the top plate and the upper surface of the bottom plate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
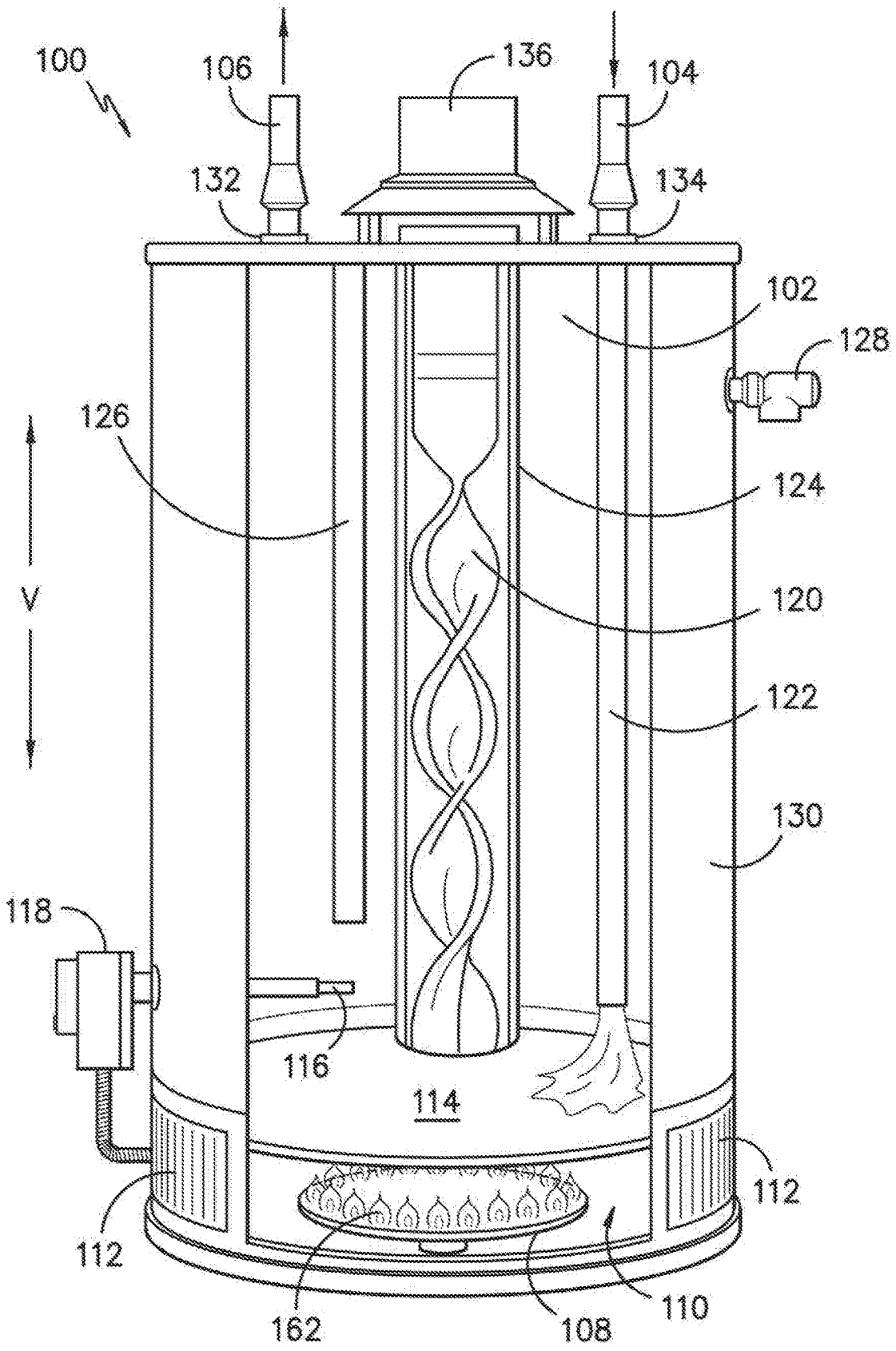
FIG. 1 provides a partially cut away, side view of a water heater appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates a partial sectional, side view of an exemplary water heater 100 of the present invention. Water heater 100 includes a tank 102 where water is stored and heated. Water is supplied to tank 102 by inlet line 104. Heated water is supplied by tank 102 through outlet line 106. Water heater 100 is fluidly connected with lines 104 and 106 using connections 132 and 134. In turn, lines 104 and 106 connect with the water supply system of, for example, a residence or a commercial structure.

From line 104, water travels into tank 102 through a cold water dip tube 122 that generally extends along a vertical direction V towards the bottom 114 of tank 102. After being heated, water exits tank 102 by travelling vertically upward and out through outlet line 106. Anode rod 126 provides protection against corrosion attacks on tank 102 and other metal components of water heater 100. A pressure relief valve 128 provides for a release of water from tank 102 in the event the pressure rises above a predetermined amount.

Water heater 100 includes a combustion chamber 110 in which a gas burner 108 is centrally located. Gas burner 108 is supplied with a gaseous fuel (e.g., propane or natural gas). Air travels into combustion chamber 110 through flame arrestor 200 after passing through air intake 112 in cabinet 130. The resulting mixture of air and gas is ignited and burned to heat bottom 114 of tank 102 and its water contents. Hot combustion gas 120 exits combustion chamber 110 through a vent or flue 124 centrally located within tank 102. Heat exchange with flue 124 also helps heat water in tank 102. A baffle 120 promotes this heat exchange. Gas 120 exits water heater 100 though vent hood 136, which may be connected with additional vent piping (not shown).

A thermostat 116 measures the temperature of water in tank 102 and provides a signal to gas control valve module 118. As used herein, "a signal" is not limited to a single measurement of temperature and, instead, may include multiple measurements over time or continuous measurements over time. The signal may be provided through, for example, changes in current, voltage, resistance, or others. Depending upon whether the desired temperature has been reached as determined, for example, from the signal from thermostat 116, gas control valve module 118 regulates the flow of gas to burner 108.

Figure 2:
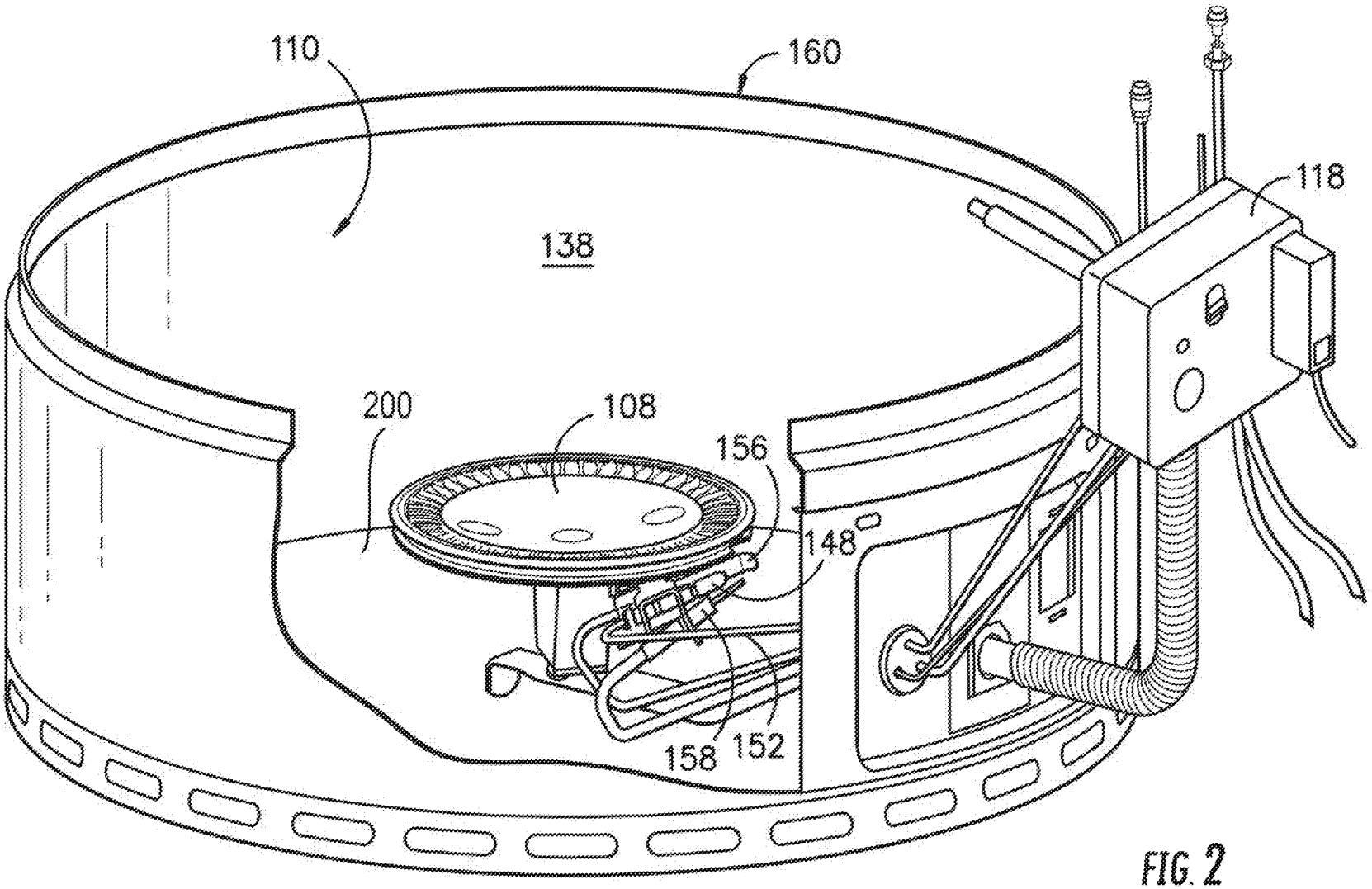
FIG. 2 provides a perspective view of an exemplary gas combustion chamber as may be used with the exemplary water heater appliance of FIG. 1.

Referring now to FIG. 2, combustion chamber 110 is formed by a chamber wall 138 that at least partially encloses combustion chamber 110 and may also provide support for tank 102 along top edge 160. As shown, chamber wall 138 encircles burner 108 and is spaced apart from burner 108. Chamber wall 138 may be part of cabinet 130 (FIG. 1) or may be a separate component. A flame arrestor 200 may extend along or across a bottom portion of chamber wall 138. In particular, flame arrestor 200 may be positioned between burner 108 and air intakes 112 along the vertical direction V. In other words, flame arrestor 200 may define a lower limit of the combustion chamber 200, below burner 108 and above air intakes 112. Air entering combustion chamber 200 will thus pass air intakes 112 before passing through flame arrestor 200 then combustion chamber 110.

Figure 3:
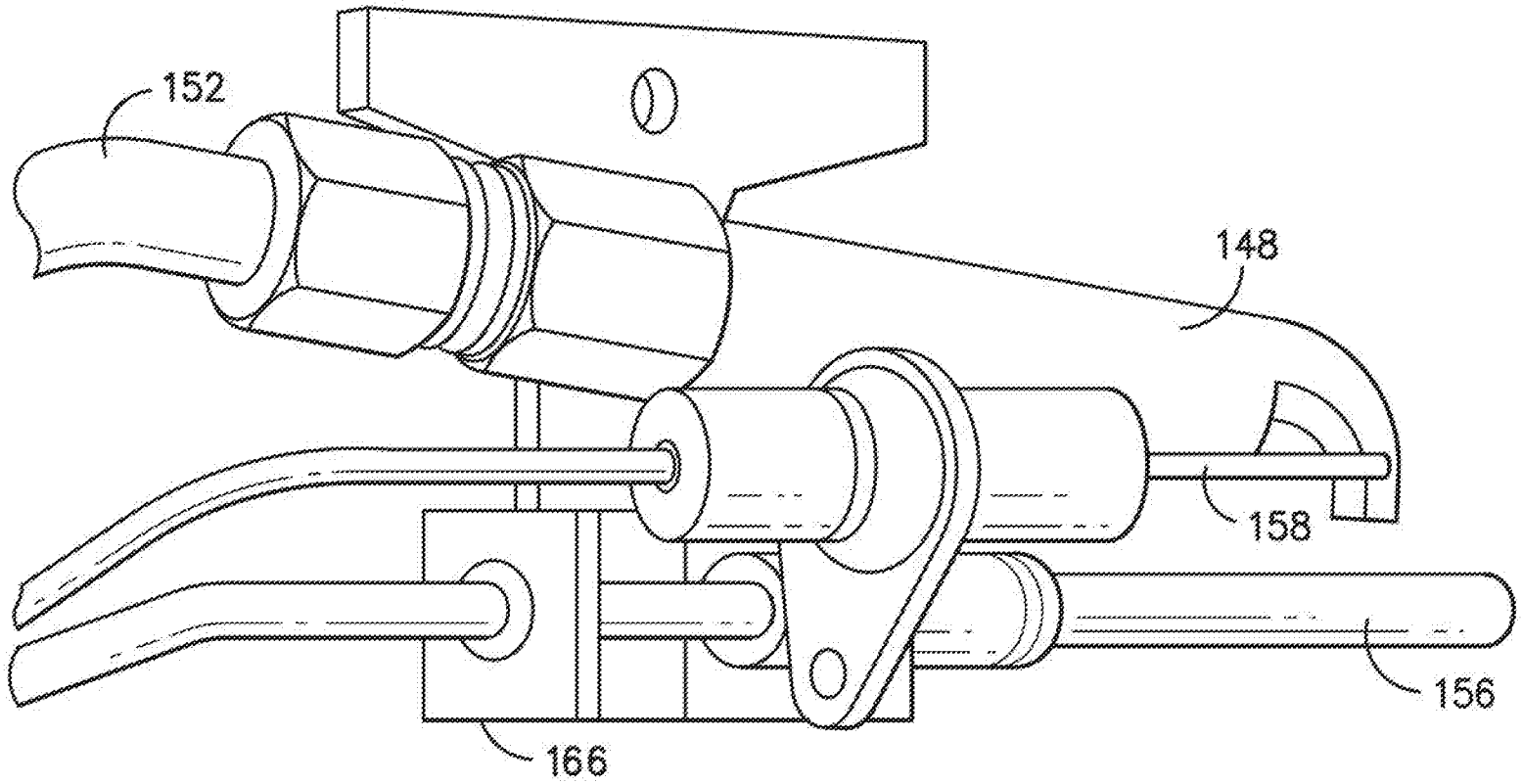
FIG. 3 provides a close-up view of certain exemplary components positioned adjacent to burner of the exemplary water heater appliance of FIGS. 1 and 2.

FIG. 3 provides a close-up view of certain components positioned beneath and directly adjacent to gas burner 108. Water heater 100 includes a pilot burner 148 that provides a pilot light to ignite a mixture of air and fuel at burner 108 when a gas valve (not shown) is open. An igniter 158 is positioned adjacent to pilot burner 148 and generates a spark used to ignite gaseous fuel and provide the pilot light. Gaseous fuel for pilot burner 108 is supplied by pilot burner fuel line 152. Gas valve control module 118 controls the flow of gaseous fuel through pilot burner fuel line 152 and the flow of gas to burner 108 from a gaseous fuel supply.

A thermo-electric device 156 is positioned adjacent to the pilot burner 148 and igniter 158. Thermo-electric device 156 may be a thermopile that can convert heat from pilot burner 148 into electrical energy, which can be used, for example, to power gas valve control module 118. Thermopile 156 may be constructed from, for example, a plurality of thermocouples connected in a series, for example. For this exemplary embodiment, a bracket 166 is used to position pilot burner 148, igniter 158, and thermopile 156 near gas burner 108.

Figure 4:
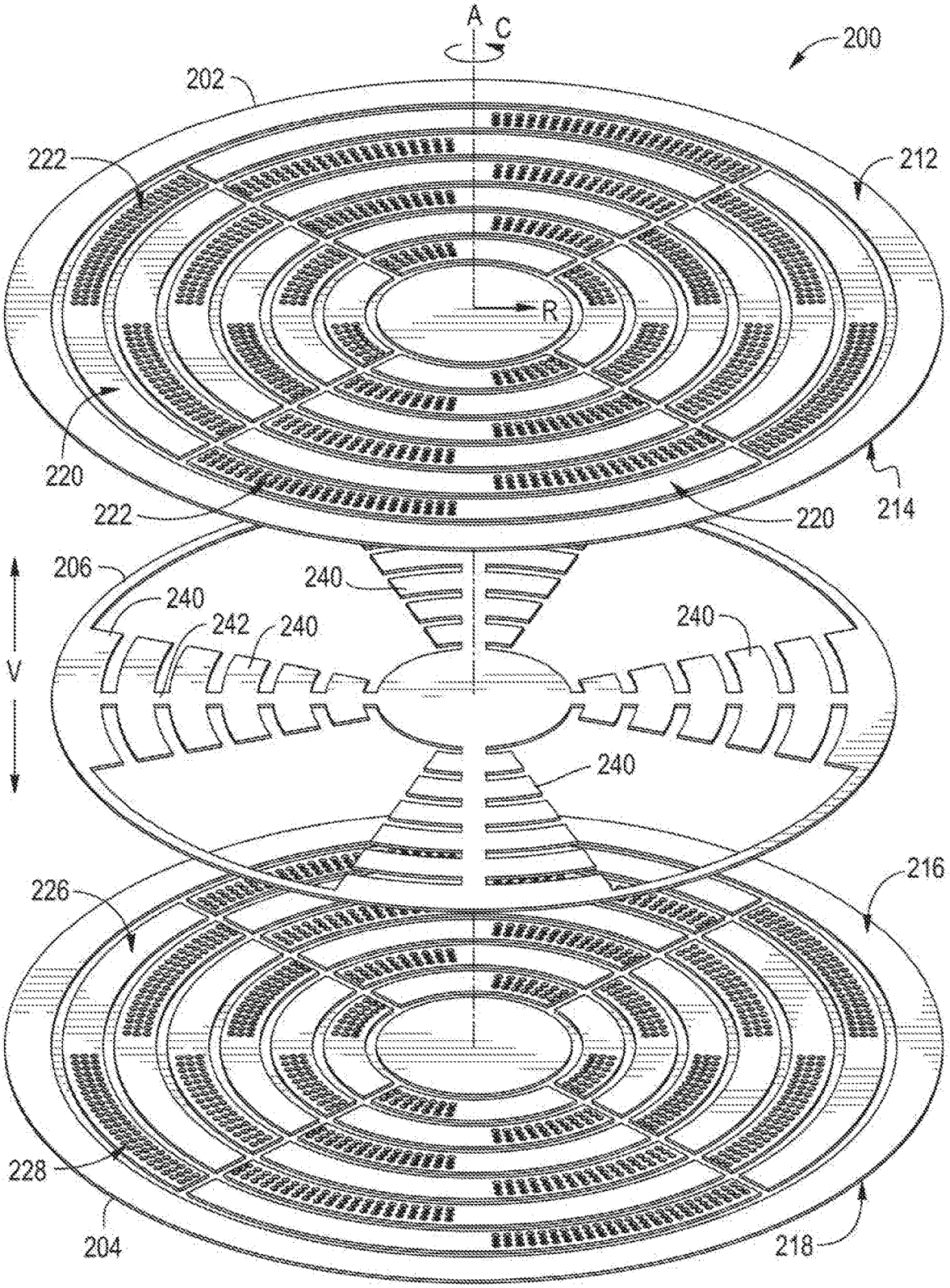
FIG. 4 provides an exploded perspective view of a flame arrestor for a water heater appliance according to exemplary embodiments of the present disclosure.

Turning now to FIGS. 4 through 12, various views of an exemplary flame arrestor 200, including portions thereof, for water heater 100 are illustrated. As shown in FIG. 4, flame arrestor 200 includes a separate top plate 202 and bottom plate 204. In some embodiments, a baffle 206 is positioned between the two plates (e.g., along the vertical direction V). Generally, flame arrestor 200 defines a central axis A about which and from which top plate 202, bottom plate 204, and/or baffle 206 extend. When assembled within water heater 100 (FIG. 2), the central axis A may be, for example, parallel to the vertical direction V. A radial direction R may be defined outward from the central axis A (e.g., perpendicular to the central axis A). A circumferential direction C may be defined about the central axis A.

Figure 5:
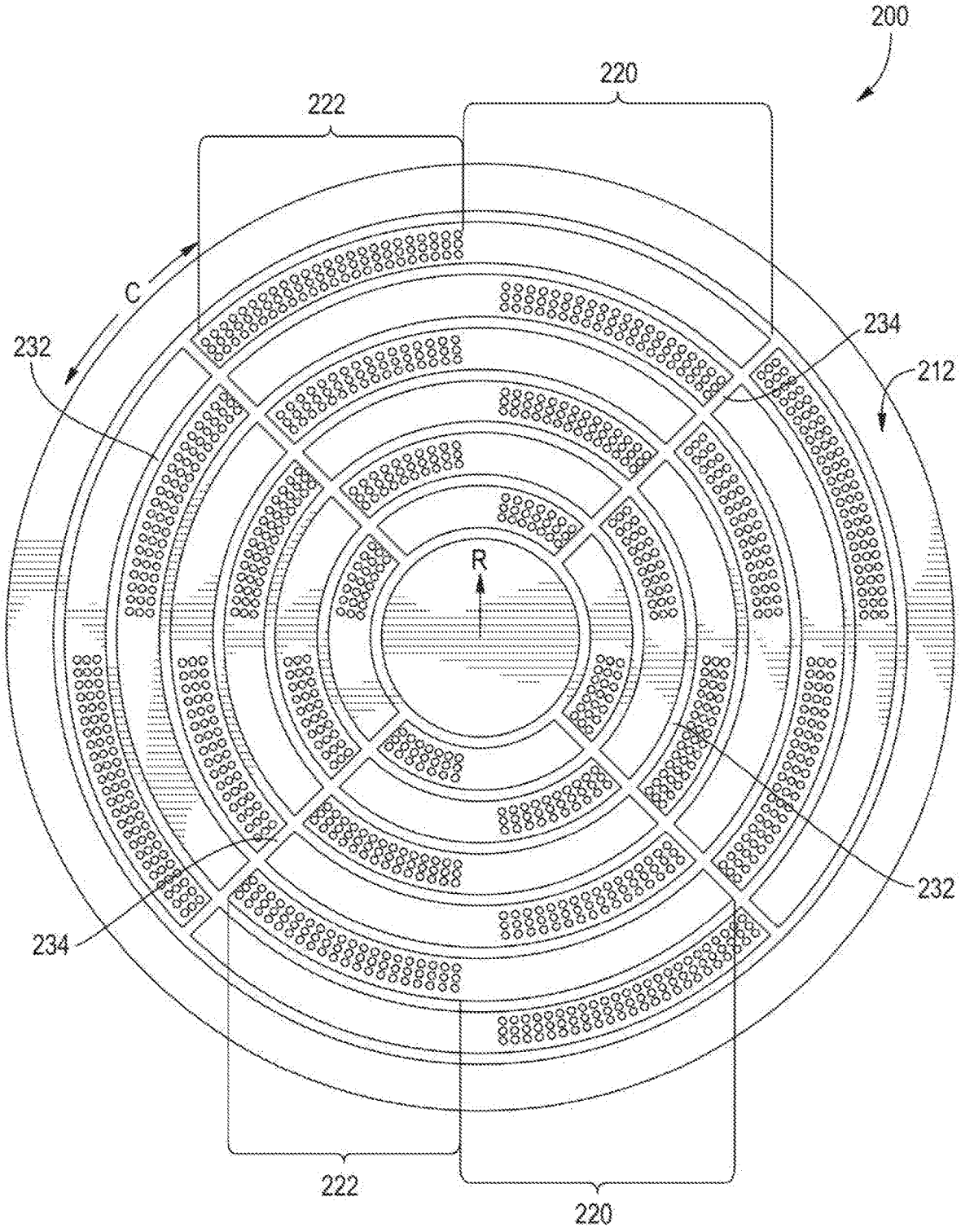
FIG. 5 provides a top view of the exemplary flame arrestor of FIG. 4.
Figure 6:
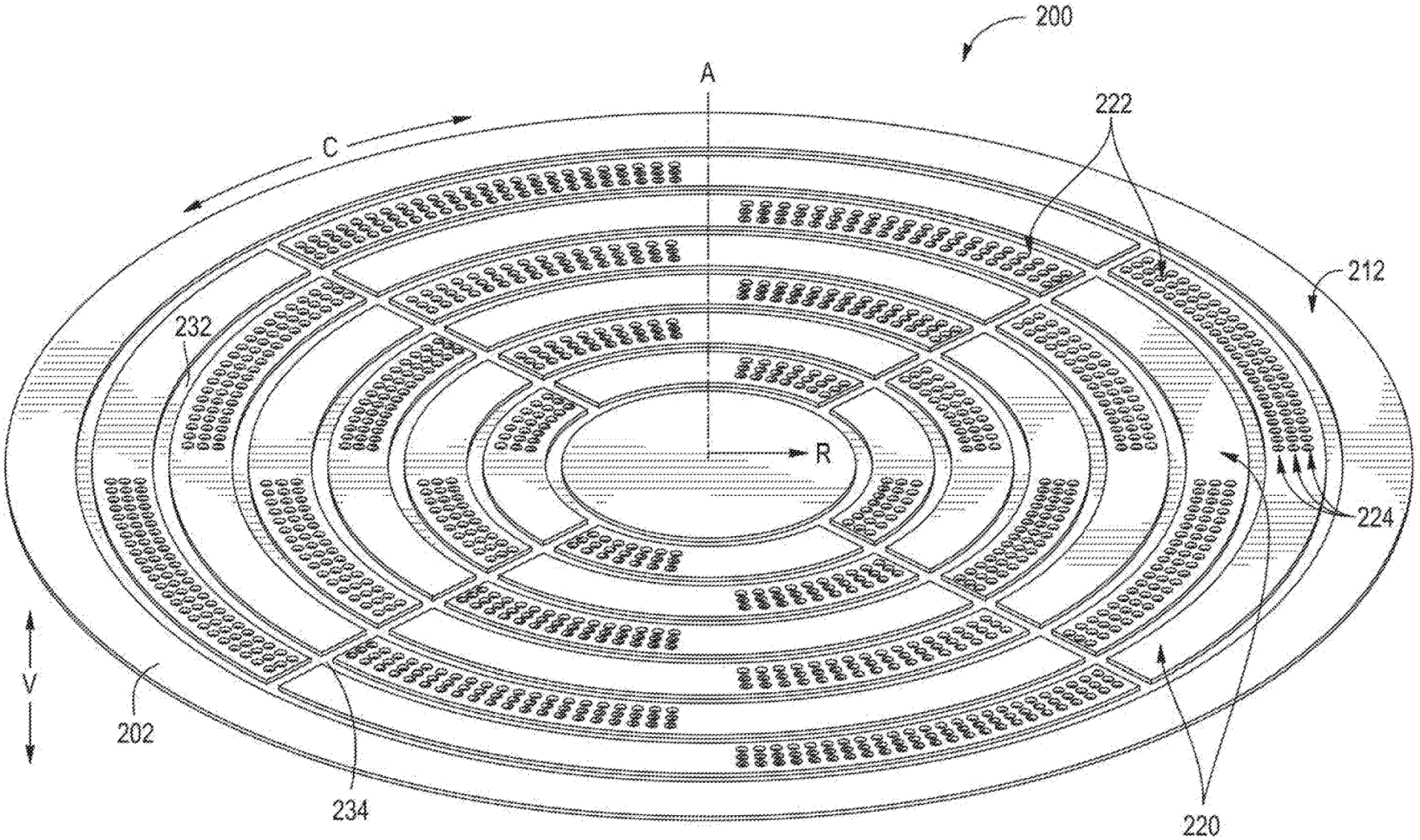
FIG. 6 provides a perspective view of the exemplary flame arrestor of FIG. 4.
Figure 7:
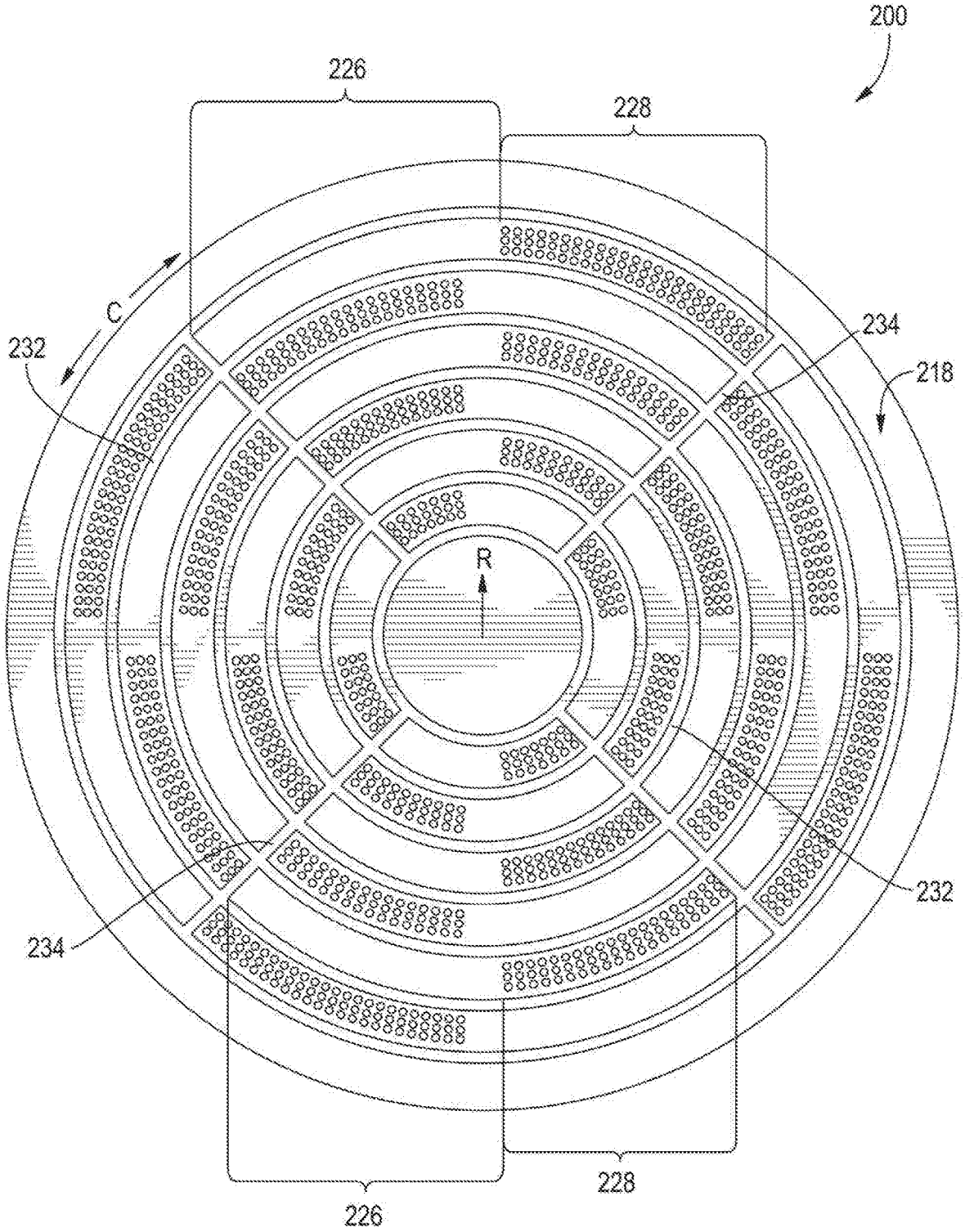
FIG. 7 provides a bottom view of the exemplary flame arrestor of FIG. 4.
Figure 8:
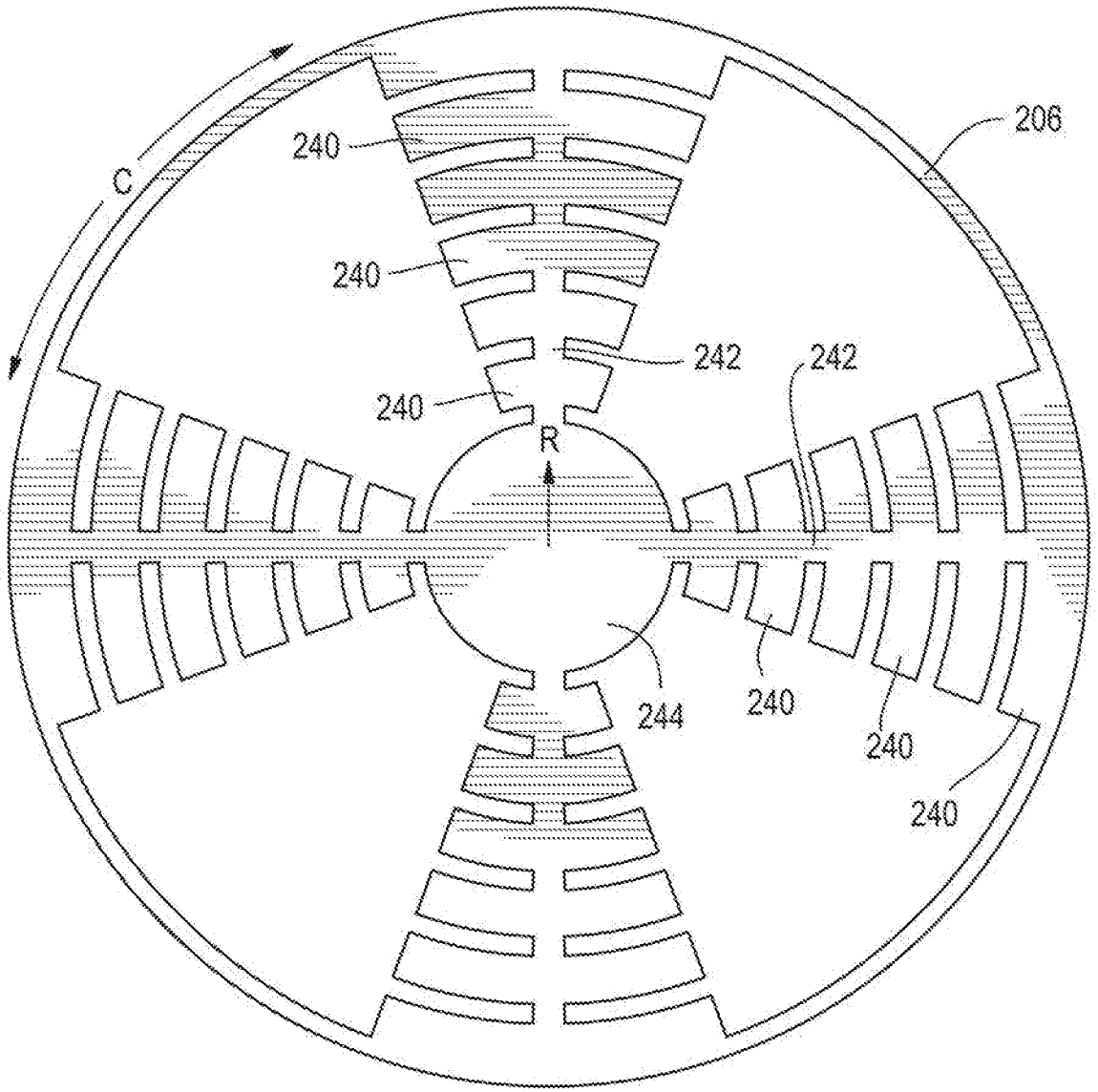
FIG. 8 provides a top view of the baffle of the exemplary flame arrestor of FIG. 4.
Figure 9:
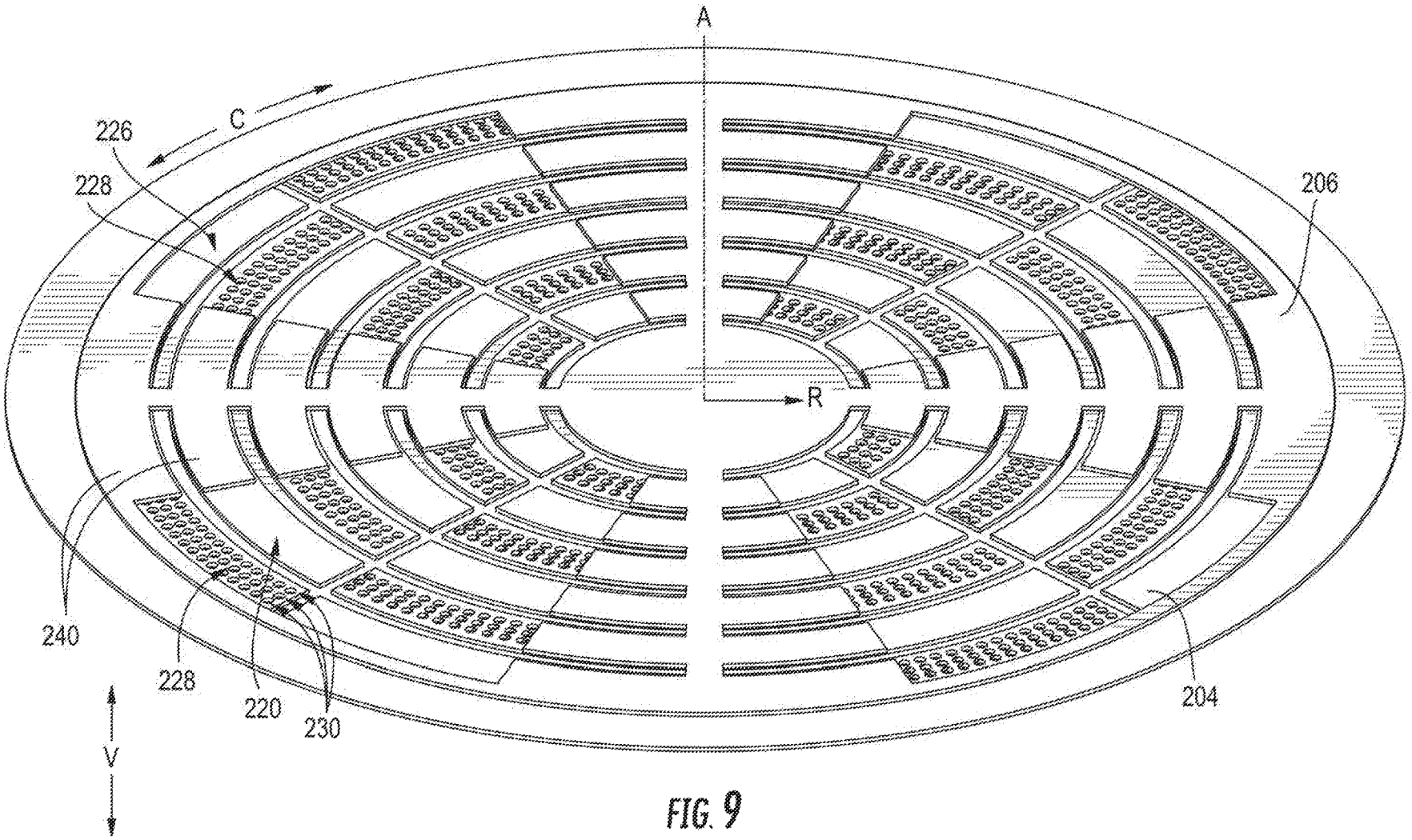
FIG. 9 provides a perspective view of the bottom plate and the baffle of the exemplary flame arrestor of FIG. 4.

Although FIG. 4 illustrates top plate 202, bottom plate 204, and baffle 206 in an exploded view, it is understood that the assembled flame arrestor 200 includes the components in stacked engagement such that baffle 206 and/or top plate 202 are supported on bottom plate 204, as shown in FIGS. 5 through 7. In certain embodiments, the plates 202, 204 and/or baffle 206 are mutually attached or joined together (e.g., via one or more adhesive, weld, clinch, or suitable mechanical connector, such as a bolt, clasp, or adjoining tab system).

Figure 11:
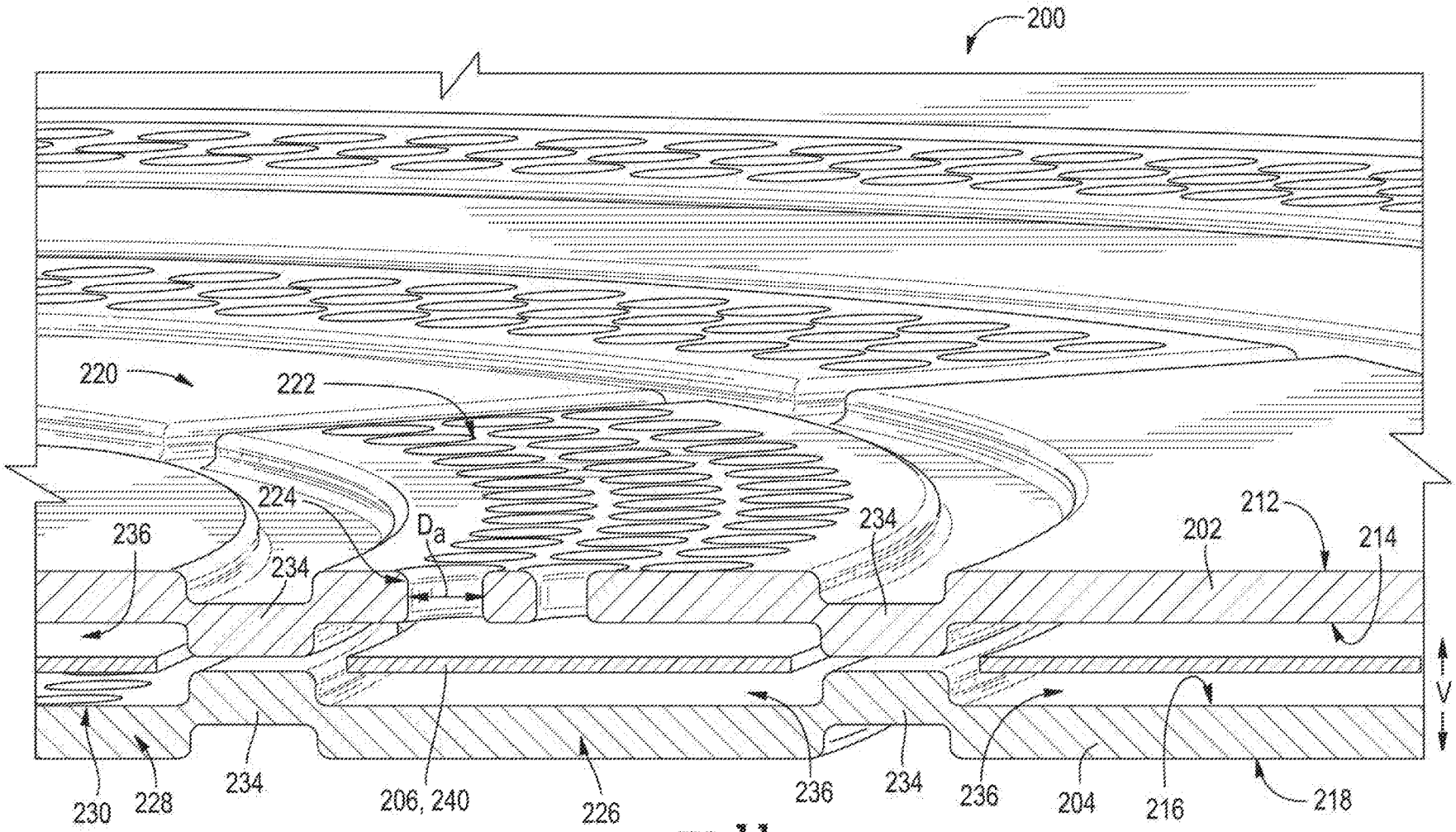
FIG. 11 provides a cross-sectional perspective view of a portion of the exemplary flame arrestor of FIG. 4.

As shown in FIGS. 4 through 6, as well as FIG. 11, top plate 202 includes an upper surface 212 and a lower surface 214. The upper and lower surfaces 212, 214 may be oppositely disposed (e.g., along the central axis A or vertical direction V). One or more non-permeable regions 220 may be defined on top plate 202. Separately, one or more perforated regions 222 may be defined on top plate 202.

Within each perforated region 222, a plurality of apertures 224 (see FIGS. 6 and 11) is provided. Each aperture 224 extends through top plate 202 from the upper surface 212 to the lower surface 214. For instance, each aperture 224 may extend along the vertical direction V, or otherwise parallel to the central axis A. Air may thus be permitted through each aperture 224, as will be described below.

As shown, each aperture 224 defines a diameter $D_a$ (e.g., minimum diameter perpendicular to the vertical direction V and/or central axis A) between the upper surface 212 and the lower surface 214. In some such embodiments, the diameter $D_a$ is constant from the upper surface 212 to the lower surface 214. The diameter $D_a$ of each aperture 224 may be any suitable length for permitting the passage of air and necessary flame quenching through the same aperture 224. In certain embodiments, an aperture 224 (e.g., each aperture 224 or, alternatively, less than every aperture 224) includes a diameter $D_a$ that is greater than five hundredths of an inch (i.e., $D_a$>0.05 in). Advantageously, top plate 202 may limit or prevent apertures 224 from becoming clogged by foreign objects, such as dirt, oil, lint, etc.

Optionally, the apertures 224 of a respective perforated region 222 may be closely spaced to each other (e.g., horizontally or along a plane perpendicular to the vertical direction V). For instance, the spacing or portion of solid material between each adjacent aperture 224 of a respective perforated region 222 may be less than the diameter $D_a$ (e.g., minimum diameter) of a single aperture 224.

In contrast to the perforated regions 222, each non-permeable region 220 is substantially solid. Specifically, each non-permeable region 220 is hermetically closed. Each non-permeable region 220 may thus be free of any void that would permit the passage of air between the upper surface 212 and the lower surface 214. In some such embodiments, the material of top plate 202 may be continuous from the lower surface 214 to the upper surface 212.

As shown, especially in FIG. 5, each perforated region 222 is paired with a corresponding non-permeable region 220 (the paired regions 220 and 222 being indicated by adjacent brackets in the context of FIG. 5). Multiple pairs of a corresponding perforated and non-permeable region 222 and 220 may be provided. Moreover, the pairs may be spaced or separated along one more direction relative to the central axis A. In the exemplary embodiments of FIGS. 4 through 6, multiple pairs of a perforated region 222 and a non-permeable region 220 are spaced apart from each other along the radial direction R and the circumferential direction C.

In additional or alternative embodiments, one or more ridges 232, 234 separate or delineate discrete regions (e.g., unique perforated regions 222 and/or unique pairs of a perforated region 222 and a non-permeable region 220). For instance, such ridges 232, 234 may be embossed along top plate 202 to extend towards bottom plate 204 (e.g., when assembled). In certain embodiments, a discrete circumferential ridge 232 and radial ridge 234 are included. As shown, a circumferential ridge 232 extends along the circumferential direction C about the central axis A. In the illustrated embodiments, multiple circumferential ridges 232 are formed in parallel and spaced apart along the radial direction R. In turn, each circumferential ridge 232 separates at least two unique pairs of a corresponding perforated region 222 and non-permeable region 220 along the radial direction R. A radial ridge 234 extends along the radial direction R from the central axis A. In the illustrated embodiments, multiple radial ridges 234 are formed at discrete angles relative to the central axis A (i.e., at different positions along the circumferential direction C). In turn, each radial ridge 234 separates at least two unique pairs of a corresponding perforated region 222 and non-permeable region 220.

As shown in FIGS. 4, 7, 9, and 11, bottom plate 204 includes an upper surface 216 and a lower surface 218. The upper and lower surfaces 216, 218 may be oppositely disposed (e.g., along the central axis A or vertical direction V). One or more non-permeable regions 226 may be defined on bottom plate 204. Separately, one or more perforated regions 228 may be defined on bottom plate 204.

Within each perforated region 228, a plurality of apertures 230 (see FIGS. 9 and 11) is provided. Each aperture 230 extends through bottom plate 204 from the upper surface 216 to the lower surface 218. For instance, each aperture 230 may extend along the vertical direction V, or otherwise parallel to the central axis A. Air may thus be permitted through each aperture 230, as will be described below.

As shown, each aperture 230 defines a diameter $D_a$ (e.g., minimum diameter perpendicular to the vertical direction V and/or central axis A) between the upper surface 216 and the lower surface 218. In some such embodiments, the diameter $D_a$ is constant from the upper surface 216 to the lower surface 218. The diameter $D_a$ of each aperture 230 may be any suitable length for permitting the passage of air and necessary flame quenching through the same aperture 230. In certain embodiments, an aperture 230 (e.g., each aperture 230 or, alternatively, less than every aperture 230) includes a diameter $D_a$ that is greater than five hundredths of an inch (i.e., $D_a$>0.05 in). Advantageously, bottom plate 204 may limit or prevent apertures 230 from becoming clogged by foreign objects, such as dirt, oil, lint, etc.

Optionally, the apertures 230 of a respective perforated region 228 may be closely spaced to each other (e.g., horizontally or along a plane perpendicular to the vertical direction V). For instance, the spacing or portion of solid material between each adjacent aperture 230 of a respective perforated region 228 may be less than the diameter $D_a$ of the apertures 230.

In contrast to the perforated regions 228, each non-permeable region 226 is substantially solid. Specifically, each non-permeable region 226 is hermetically closed. Each non-permeable region 226 may thus be free of air void that would permit the passage of air between the upper surface 216 and the lower surface 218. In some such embodiments, the material of bottom plate 204 may be continuous from the lower surface 218 to the upper surface 216.

As shown, especially in FIG. 7, each perforated region 228 is paired with a corresponding non-permeable region 226 (the paired regions 228 and 226 being indicated by adjacent brackets in the context of FIG. 7). Multiple pairs of a corresponding perforated and non-permeable region 228 and 226 may be provided. Moreover, the pairs may be spaced or separated along one more direction relative to the central axis A. In the exemplary embodiments of FIGS. 4, 7, 9, and 11, multiple pairs of a perforated region 228 and a non-permeable region 226 are spaced apart from each other along the radial direction R and the circumferential direction C.

In additional or alternative embodiments, one or more ridges 232, 234 separate or delineate discrete regions (e.g., unique perforated regions 228 and/or unique pairs of a perforated region 228 and a non-permeable region 226). For instance, such ridges 232, 234 may be embossed along bottom plate 204 to extend towards top plate 202 (e.g., when assembled). In certain embodiments, a discrete circumferential ridge 232 and radial ridge 234 are included. As shown, a circumferential ridge 232 extends along the circumferential direction C about the central axis A. In the illustrated embodiments, multiple circumferential ridges 232 are formed in parallel and spaced apart along the radial direction R. In turn, each circumferential ridge 232 separates at least two unique pairs of a corresponding perforated region 228 and non-permeable region 226 along the radial direction R. A radial ridge 234 extends along the radial direction R from the central axis A. In the illustrated embodiments, multiple radial ridges 234 are formed at discrete angles about the central axis A (e.g., separate points along the circumferential direction C). In turn, each radial ridge 234 separates at least two unique pairs of a corresponding perforated region 228 and non-permeable region 226.

Figure 10:
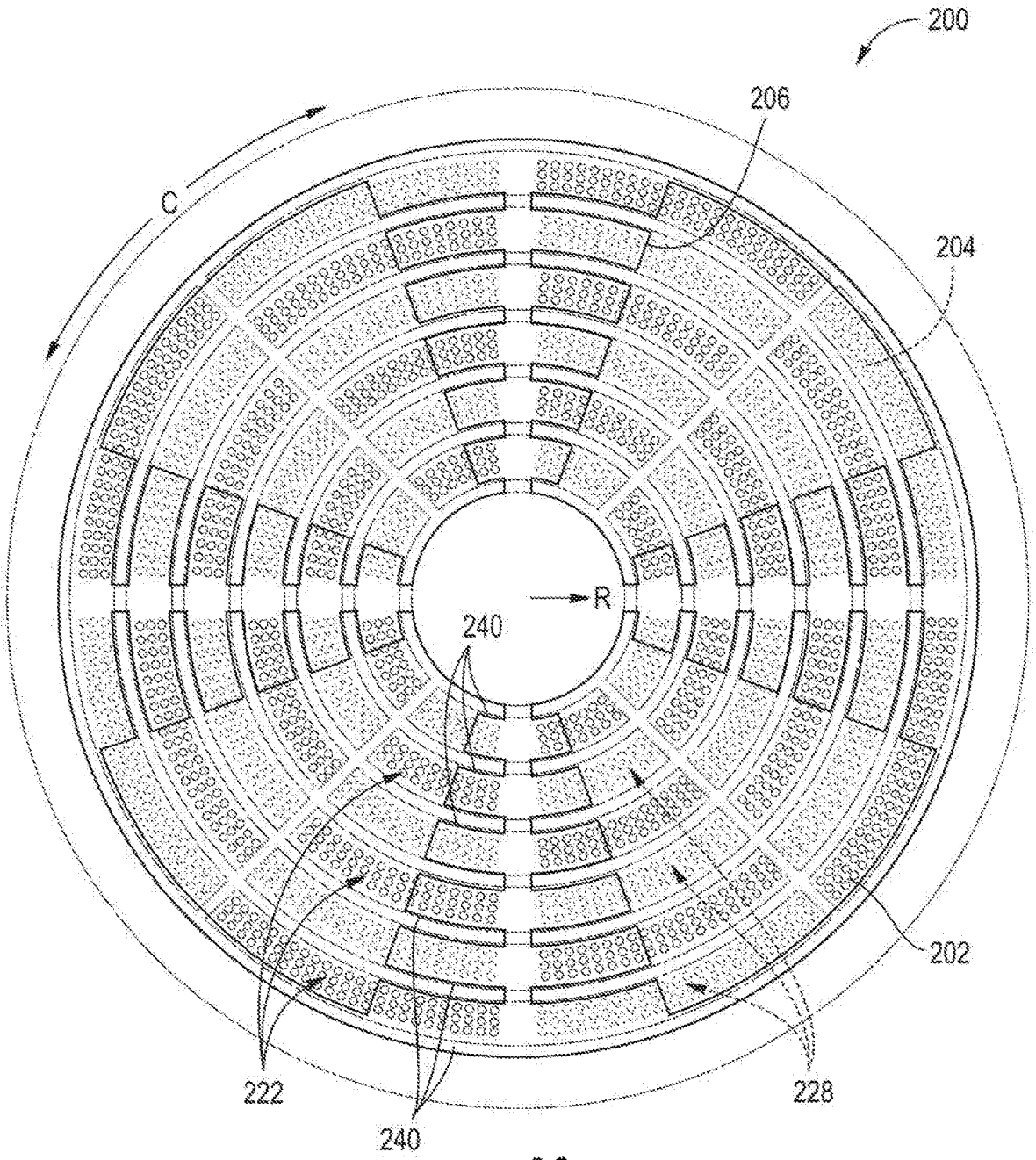
FIG. 10 provides a transparent plan view of the exemplary flame arrestor of FIG. 4.
Figure 12:
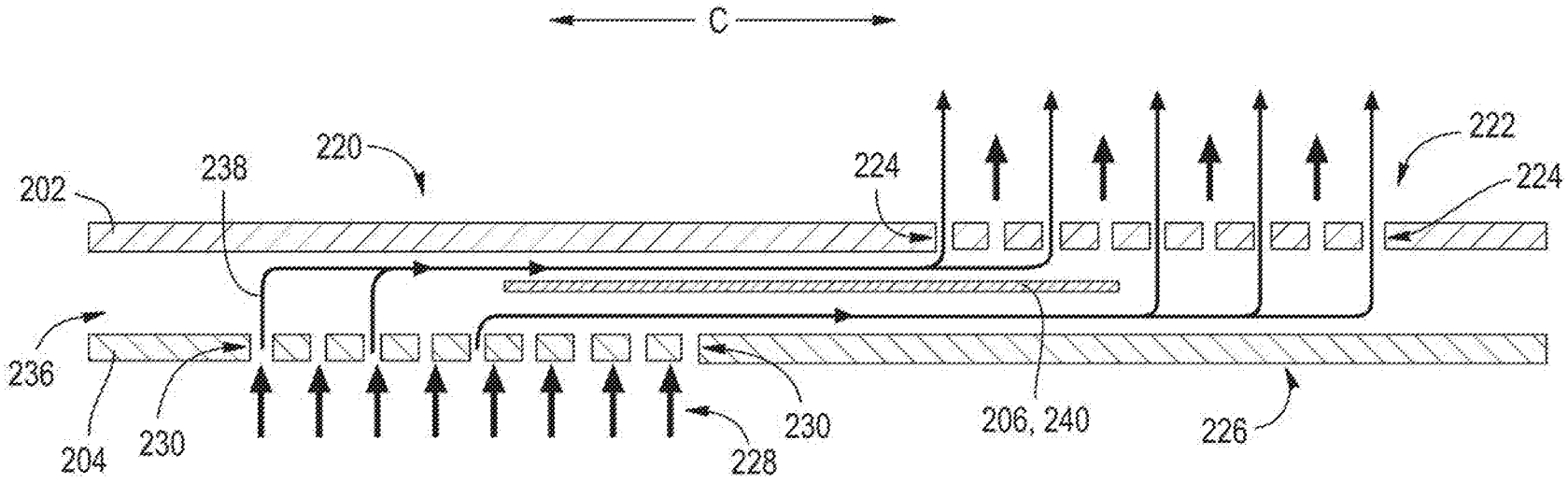
FIG. 12 provides a cross-sectional schematic view of a portion of the exemplary flame arrestor of FIG. 4.

Turning especially to FIGS. 10 through 12, flame arrestor 200 defines one or more air channels 236 between top plate 202 and bottom plate 204. For instance, at an air channel 236, at least a portion of the lower surface 214 of top plate 202 may be spaced apart from the upper surface 216 of the bottom plate 204 (e.g., along the vertical direction V). In some such embodiments, a pair of top plate regions 220 and 222 is aligned (e.g., vertically aligned) with a pair of bottom plate 204 regions 226 and 228. Specifically, a pair of a corresponding perforated region 222 and non-permeable region 220 of top plate 202 is matched to a pair of a corresponding perforated region 228 and non-permeable region 226 of bottom plate 204. A unique air channel 236 is defined between the pairs.

Optionally, one or more ridges 232, 234 may support top plate 202 on bottom plate 204. For instance, the radial ridges 234 and circumferential ridges 232 of top plate 202 may be aligned (e.g., vertically aligned) with the radial ridges 234 and circumferential ridges 232 of bottom plate 204. In turn, the ridges 232, 234 of bottom plate 204 may engage the ridges 232, 234 of top plate 202, in support therewith.

As shown, some embodiments of flame arrestor 200 include portions of top plate 202 and bottom plate 204 at axially offset positions. In other words, at least a portion of top plate 202 is spaced apart from a portion of bottom plate 204 relative to (e.g., from or about) a common axis or direction. For example, a perforated region 222 of top plate 202 may be axially offset from a perforated region 228 of bottom plate 204. Specifically, the perforated region 222 of top plate 202 may be offset from the perforated region 228 of the bottom plate 204 relative to the central axis A and/or vertical direction V. Thus, the perforated regions 222 and 228 may be positioned at different distances and/or angles from the central axis A.

In some embodiments, the perforated region 222 of the top plate 202 is offset (e.g., spaced apart) from the perforated region 228 of the bottom plate 204 along the radial direction R. In additional or alternative embodiments, the perforated region 222 of the top plate 202 is offset (e.g., spaced apart) from the perforated region 228 of the bottom plate 204 along the circumferential direction C. If a plurality of perforated regions 222, 228 are included in top plate 202 and/or bottom plate 204, each perforated region 222 of top plate 202 may be axially offset from each perforated region 228 of bottom plate 204 (e.g., along one or more of the radial direction R or the circumferential direction C).

In contrast to the perforated regions 222 and 228, a portion of a non-permeable region 220 of top plate 202 may axially overlap with a portion of a non-permeable region 226 of bottom plate 204. Specifically, a segment of a non-permeable region 220 of top plate 202 may overlap a segment of a non-permeable region 226 of bottom plate 204 relative to the central axis A and/or vertical direction V. In such embodiments, the overlapping segments of the non-permeable regions 220 and 226 are vertically aligned with each other. In turn, the overlapping segment of the non-permeable region 226 of the bottom plate 204 is positioned directly beneath the overlapping segment of the non-permeable region 220 of the top plate 202 (i.e., along the vertical direction). Moreover, the overlapping segments are positioned at the same location (e.g., point) along the radial direction R and the circumferential direction C.

As illustrated in FIGS. 10 through 11, exemplary embodiments of flame arrestor 200 include multiple perforated regions 222 and 228 that are offset between top plate 202 and bottom plate 204, as well as multiple non-permeable regions 220 and 226 that partially overlap. Specifically, each perforated region 222 of top plate 202 is axially offset from each other perforated region 228 of top plate 202. Between matched pairs of regions (e.g., portions of top plate 202 and bottom plate 204 that together define a corresponding air channel 236), the matched perforated region 222 of top plate 202 is offset from the matched perforated region 228 of bottom plate 204 relative to the central axis A along the circumferential direction C. Between non-matched pairs of regions that share the same circumferential position (e.g., at unique radial positions and/or air channels 236), a perforated region 222 of top plate 202 is offset from one or more perforated regions 228 of bottom plate 204 relative to the central axis A along the circumferential direction C. Between non-matched pairs of regions that share the same radial position (e.g., at unique circumferential positions and/or air channels 236), a perforated region 222 of top plate 202 is further offset from one or more perforated regions 228 of bottom plate 204 relative to the central axis A along the radial direction R.

In exemplary embodiments, such as those shown in FIG. 10, both plates 202 and 204 may be substantially similar or identical in size. For instance, both plates 202 and 204 may be formed as circular discs having the same diameter. Moreover, the size and shape of perforated regions 222 and non-permeable regions 220 of top plate 202 may be substantially similar to respective perforated regions 228 and non-permeable regions 226 of bottom plate 204. In some such embodiments, top plate 202 is joined to bottom plate 204 at a predetermined offset angle about the central axis A. The offset angle may be such that each perforated region 222 and 228 is vertically aligned with a non-permeable region 226 and 220, respectively. In other words, the plates 202 and 204 are coaxially positioned on the central axis A, but at different angles about the central axis A (i.e., at different positions along the circumferential direction C). Such embodiments of flame arrestor 200 thus ensure that the perforated regions 222 are not vertically aligned with perforated regions 228 and that no aperture 224 is coaxial with an aperture 230.

Turning particularly to FIGS. 4 and 8 through 12, some embodiments of flame arrestor 200 include a baffle 206 extending about the central axis A. When assembled, baffle 206 may be generally positioned between the plates 202, 204 (e.g., along the central axis A). In particular, baffle 206 may be positioned between the lower surface 214 of top plate 202 and the upper surface 216 of bottom plate 204 along the central axis A and/or vertical direction V.

Generally, baffle 206 includes one or more solid or non-permeable portions, such as guide panels 240, extending beneath top plate 202 and above bottom plate 204. In the exemplary embodiments of FIGS. 8 through 12, baffle 206 includes a plurality of substantially solid guide panels 240. Each guide panel 240 may extend, for instance, along a portion of the circumferential direction C. Optionally, one or more neck panels 242 extends along the radial direction R, connecting adjacent guide panels 240 to each other and/or a central panel 244.

As illustrated, especially in FIG. 10, in some embodiments, baffle 206 axially overlaps with at least a portion of a perforated region 222 and 228. For instance, a guide panel 240 of baffle 206 may extend directly below all or some of a perforated region 222 of top plate 202 along the vertical direction V. Additionally or alternatively, a guide panel 240 may extend directly above all or some of a perforated region 228 of bottom plate 204. In certain embodiments, a single guide panel 240 overlaps (e.g., extends directly below) a portion of a perforated region 222 of top plate 202 and also overlaps (e.g., extends directly above) a portion of a perforated region 228 of bottom plate 204. Within a specific guide panel 240 the single guide panel 240 may thus overlap a portion of the non-permeable regions 220, 226 and perforated regions 222, 228 of the plates 202, 204. During use, baffle 206 may further restrict and direct the movement of air and necessary flame quenching through a guide panel 240, advantageously increasing the surface area of flame arrestor 200 that may contact the air passing therethrough.

As shown in FIGS. 11 and 12, an overlapping guide panel 240 may be held within a corresponding air channel 236. In some such embodiments, the guide panel 240 is spaced apart from at least a portion of the lower surface 214 of top plate 202 along the vertical direction V. In further embodiments, the guide panel 240 is spaced apart from at least a portion of the upper surface 216 of lower plate 204 along the vertical direction V. In turn, air through guide panel 240 may be generally permitted to flow above and/or below baffle 206.

Turning specifically to FIG. 12, airflow (generally indicated at arrows 238) through a particular air channel 236 is illustrated. As shown, airflow 238 may pass into and through the apertures 230 of the perforated region 228 of the bottom plate 204 (e.g., along the vertical direction V) before entering air channel 236. Within air channel 236, vertical movement is limited (e.g., by non-permeable region 220 and/or baffle 206) such that airflow 238 is directed through air channel 236 (e.g., along the circumferential direction C). As airflow 238 travels within air channel 236, airflow at least a portion of airflow 236 may be directed around (e.g., above or below) guide panel 240 before reaching the perforated region 222. Upon reaching the perforated region 222 of the top plate 202, airflow 238 may subsequently pass through the apertures 224 (e.g., along the vertical direction V and/or into combustion chamber 110—see FIG. 10).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas fueled water heater, comprising:
a tank for storage of water for heating;
a chamber wall defining a combustion chamber;
a gas burner positioned adjacent to the tank and within the combustion chamber to heat the water in the tank; and
a flame arrestor positioned beneath the gas burner along a vertical direction, the flame arrestor comprising
a bottom plate comprising an upper surface and a lower surface, the bottom plate defining a non-permeable region and a perforated region, the perforated region comprising a plurality of apertures extending through the bottom plate from the upper surface to the lower surface,
a top plate positioned above the bottom plate along the vertical direction, the top plate comprising an upper surface and a lower surface, the top plate defining a non-permeable region and a perforated region, the perforated region comprising a plurality of apertures extending through the top plate from the upper surface to the lower surface, and
a baffle positioned between the top plate and the bottom plate along the vertical direction,
wherein the perforated region of the bottom plate is axially offset from the perforated region of the top plate,
wherein one or more apertures of the plurality of apertures of the top plate is defined at a diameter greater than five hundredths of an inch, and
wherein a spacing of solid material is provided between adjacent apertures of the plurality of apertures of the top plate, wherein the spacing is less than the one or more apertures of the plurality of apertures.

2. The gas fueled water heater of claim 1, wherein the flame arrestor defines a plurality of discrete air channels between the bottom plate and the top plate along the vertical direction.

3. The gas fueled water heater of claim 1, wherein a portion of the non-permeable region of the bottom plate axially overlaps a portion of the non-permeable region of the top plate.

4. The gas fueled water heater of claim 1, wherein the baffle axially overlaps a portion of the perforated region of the top plate or the bottom plate.

5. The gas fueled water heater of claim 1, wherein the baffle axially overlaps a portion of the perforated region of the top plate, and wherein the baffle axially overlaps a portion of the perforated region of the bottom plate.

6. The gas fueled water heater of claim 1, wherein one or more apertures of the plurality of apertures of the bottom plate is defined at a diameter greater than five hundredths of an inch.

7. A gas fueled water heater, comprising:
a tank for storage of water for heating;
a chamber wall defining a combustion chamber;
a gas burner positioned adjacent to the tank and within the combustion chamber to heat the water in the tank; and
a flame arrestor positioned beneath the gas burner along a vertical direction, the flame arrestor comprising
a bottom plate comprising an upper surface and a lower surface, the bottom plate defining a non-permeable region and a perforated region, the perforated region comprising a plurality of apertures extending through the top plate from the upper surface to the lower surface, a top plate positioned above the bottom plate along the vertical direction, the top plate comprising an upper surface and a lower surface, the top plate defining a non-permeable region and a perforated region, the perforated region comprising a plurality of apertures extending through the top plate from the upper surface to the lower surface, and a baffle joined in fixed attachment to the bottom plate and positioned between the lower surface of the top plate and the upper surface of the bottom plate, wherein the flame arrestor defines a plurality of discrete air channels between the bottom plate and the top plate along the vertical direction, and wherein the baffle extends through each of the plurality of discrete air channels, wherein the baffle axially overlaps a portion of the perforated region of the top plate, and wherein the baffle axially overlaps a portion of the perforated region of the bottom plate.

8. The gas fueled water heater of claim 7, wherein a portion of the non-permeable region of the bottom plate axially overlaps a portion of the non-permeable region of the top plate.

9. The gas fueled water heater of claim 7, wherein the perforated region of the bottom plate is axially offset from the perforated region of the top plate relative to the vertical direction.

10. The gas fueled water heater of claim 7, wherein one or more apertures of the plurality of apertures of the top plate is defined at a diameter greater than five hundredths of an inch.

11. The gas fueled water heater of claim 10, wherein one or more apertures of the plurality of apertures of the bottom plate is defined at a diameter greater than five hundredths of an inch.

12. The gas fueled water heater of claim 7, wherein one or more apertures of the plurality of apertures of the top plate is defined at a diameter greater than five hundredths of an inch.

13. A gas fueled water heater, comprising:

a tank for storage of water for heating;

a chamber wall defining a combustion chamber;

a gas burner positioned adjacent to the tank and within the combustion chamber to heat the water in the tank; and a flame arrestor positioned beneath the gas burner along a vertical direction, the flame arrestor comprising a bottom plate comprising an upper surface and a lower surface, the bottom plate defining a non-permeable region and a perforated region, the perforated region comprising a plurality of apertures extending through the top plate from the upper surface to the lower surface, a top plate positioned above the bottom plate along the vertical direction, the top plate comprising an upper surface and a lower surface, the top plate defining a non-permeable region and a perforated region, the perforated region comprising a plurality of apertures extending through the top plate from the upper surface to the lower surface, and a baffle joined in fixed attachment to the bottom plate and positioned between the lower surface of the top plate and the upper surface of the bottom plate, wherein one or more apertures of the plurality of apertures of the top plate is defined at a diameter greater than five hundredths of an inch, wherein a spacing of solid material is provided between adjacent apertures of the plurality of apertures of the top plate, wherein the spacing is less than the one or more apertures of the plurality of apertures, wherein the baffle axially overlaps a portion of the perforated region of the top plate, and wherein the baffle axially overlaps a portion of the perforated region of the bottom plate.

14. The gas fueled water heater of claim 13, wherein one or more apertures of the plurality of apertures of the bottom plate is defined at a diameter greater than five hundredths of an inch.

* * * * *